US008950044B2

(12) United States Patent
Yamakita

(10) Patent No.: US 8,950,044 B2
(45) Date of Patent: Feb. 10, 2015

(54) FASTENER STRINGER AND SLIDE FASTENER

(75) Inventor: Yoshimichi Yamakita, Toyama (JP)

(73) Assignee: YKK Corporation (JP)

( * ) Notice: Subject to any disclaimer, the term of this patent is extended or adjusted under 35 U.S.C. 154(b) by 110 days.

(21) Appl. No.: 13/884,358

(22) PCT Filed: Nov. 10, 2010

(86) PCT No.: PCT/JP2010/070015

§ 371 (c)(1),
(2), (4) Date: May 9, 2013

(87) PCT Pub. No.: WO2012/063333

PCT Pub. Date: May 18, 2012

(65) Prior Publication Data

US 2013/0219675 A1 Aug. 29, 2013

(51) Int. Cl.

| | |
|---|---|
| ***A44B 19/34*** | (2006.01) |
| ***D02G 3/34*** | (2006.01) |
| ***A44B 19/12*** | (2006.01) |
| ***D01D 5/253*** | (2006.01) |
| *D06P 5/30* | (2006.01) |

(52) U.S. Cl.

CPC *A44B 19/34* (2013.01); *D02G 3/34* (2013.01); *A44B 19/12* (2013.01); *D06P 5/30* (2013.01); *D01D 5/253* (2013.01)

USPC ..... 24/391; 24/401

(58) Field of Classification Search

USPC ..... 24/401, 391, 392, 394, 395, 396, 397, 24/399, 402

See application file for complete search history.

(56) References Cited

U.S. PATENT DOCUMENTS

| | | | | |
|---|---|---|---|---|
| 4,604,774 | A * | 8/1986 | Yamaguchi et al. | 24/389 |
| 4,811,468 | A | 3/1989 | Yamada | |
| 4,912,819 | A | 4/1990 | Yamada | |

(Continued)

FOREIGN PATENT DOCUMENTS

| | | |
|---|---|---|
| EP | 153691 A2 | 8/1985 |
| EP | 269344 A2 | 6/1988 |

(Continued)

OTHER PUBLICATIONS

International Search Report, PCT Application No. PCT/JP2010/070015, mailed Feb. 15, 2011.

*Primary Examiner* — Robert J Sandy
*Assistant Examiner* — Rowland Do
(74) *Attorney, Agent, or Firm* — Kilpatrick Townsend & Stockton LLP

(57) ABSTRACT

A fastener stringer, is configured such that a fastener element of a continuous shape includes a plurality of fine projected rims which are continuously disposed on a peripheral surface of the monofilament (30); along a length direction of the monofilament and a plurality of fine concave grooves which are disposed between the projected rim and in a cross section of the monofilament, a cross-sectional area of a space region of the concave groove is set to be larger than that of the projected rim. With this configuration, when performing dyeing process employing a beam dyeing or a continuous dyeing method while appropriately securing the strength of the monofilament, it is possible to prevent dyeing irregularities and dyeing defects from arising. Further, when performing a coloring according to an inkjet, scheme, it is possible to finely form a desired pattern with clear outlines on the fastener element.

10 Claims, 11 Drawing Sheets

(56) References Cited

U.S. PATENT DOCUMENTS

| | | | | |
|---|---|---|---|---|
| 5,035,029 | A * | 7/1991 | Horita et al. | 24/394 |
| 5,956,818 | A * | 9/1999 | Tsubata | 24/397 |
| 2001/0004787 | A1 * | 6/2001 | Nagata et al. | 24/403 |

FOREIGN PATENT DOCUMENTS

| | | | |
|---|---|---|---|
| EP | 271210 | A1 | 6/1988 |
| JP | 60-179004 | A | 9/1985 |
| JP | 85110/1988 | | 6/1988 |
| JP | 157309/1988 | | 10/1988 |
| JP | 4-24004 | A | 10/1995 |
| JP | 7-284404 | A | 10/1995 |
| JP | 2005-160667 | A | 6/2005 |
| KR | 10-1986-0001425 | B1 | 9/1986 |
| KR | 20-1990-0004140 | Y | 5/1990 |
| WO | 2010/109658 | A1 | 9/2010 |

* cited by examiner

FASTENER STRINGER AND SLIDE FASTENER

This application is a national stage application of PCT/JP2010/070015 which is incorporated herein by reference.

TECHNICAL FIELD

The invention relates to a fastener stringer to which a continuous fastener element is attached and a slide fastener including the fastener stringer, and more particularly, to a fastener stringer in which the fastener element is colored by a coloring material.

BACKGROUND ART

In general, a slide fastener, for example, includes left and right fastener stringers in which continuous fastener elements in a coil shape or a zigzag shape are attached to fastener tapes. In this case, the continuous fastener elements in the coil or zigzag shape are manufactured such that a thermoplastic synthetic resin is molded by extrusion in a line to form a monofilament, a part of the obtained monofilament is pressed at a predetermined interval to form coupling heads, and thus the monofilament is formed in the coil or zigzag shape.

In general, clothes and bags have been made in a variety of designs, and brand new designs are developing for the purpose of enhancing the product value. In recent years, the slide fasteners used for these clothes and bags are also expected to be excellent in design, and the fastener tapes and the fastener elements in various patterns and colors are coming into the market.

An example of method for coloring the fastener tape and the fastener element includes a dyeing method employing a beam dyeing (also referred to as a piece dyeing) in which a continuous fastener stringer is wound on a dyeing beam to dye the fastener stringer by dipping the stringer-winding beam in a dyeing vessel. Further, a continuous dyeing method is known in which the continuous fastener stringer is transported while being immersed in a dyeing bath, and then the fastener stringer is subjected to thermal treatment.

In addition, as a method of making patterns on the fastener tape and the fastener element for the enhancement in designs, patterns of pictures or the like are printed on the fastener tape and the fastener element through an inkjet scheme and then the fastener stringer is subjected to thermal treatment for the coloring.

For example, a method and an apparatus for dyeing the slide fastener through the inkjet scheme are disclosed in JP 4-24004 A (Patent Document 1).

Patent Document 1 mainly describes the inkjet scheme for dyeing the slide fastener in which the fastener element is attached to the fastener tape through injection molding. However, there is no specific description about the method of dyeing the slide fastener in which the continuous fastener element described above is attached to the fastener tape.

In the method of dyeing the slide fastener disclosed in Patent Document 1, ink droplets are first ejected from inkjet nozzles onto one surface of the slide fastener provided with the fastener element formed by injection-molding a synthetic resin, so that a pattern is formed on the surface of the slide fastener. Thereafter, the patterned slide fastener is subjected to the thermal treatment to fix the dye placed on the slide fastener to the fastener tape and the fastener element.

PRIOR ART DOCUMENT

Patent Document

Patent Document 1: JP 4-24004 A

DISCLOSURE OF THE INVENTION

Problem to be Solved by the Invention

In a case where a fastener stringer or a fastener chain including a continuous fastener element formed in a coil or zigzag shape is colored, the dyeing method employing the above-mentioned beam dyeing, the continuous dyeing method, and the dyeing method employing the inkjet scheme may be used in general.

However, for example, in a case where the fastener stringer is dyed using the dying method employing the beam dyeing, a dyeing process can be performed simply and at a low cost. On the contrast, for example, since the dyeing process is performed by winding a long fastener stringer around a large beam, it is difficult to cope with mass production of various patterns in small quantities. In addition, the dyed fastener tape may be easily wrinkled like recesses.

In addition, in the dyeing method employing the beam dyeing, when the fastener stringer including the continuous fastener element is wound around the beam so as to be overlapped in several layers, the surface of the fastener element wound in each layer comes into close contact with the rear surface of the fastener tape wound in the next layer. Therefore, the dye may be blocked by the close-contact portions. For this reason, when the fastener stringer wound around the beam is dyed in the dyeing vessel, it is difficult for the dye to spread all over the fastener element, so that dyeing irregularities and dyeing defects may be caused in the dyed fastener element.

On the other hand, in a case where the continuous dyeing method or the coloring method employing the inkjet scheme is used to color the fastener stringer, the fastener stringer can be easily colored in a desired length. Therefore, it is advantageous in easily coping with the mass production of the fastener stringers in small quantities compared with the dyeing method employing the beam dyeing.

However, the continuous dyeing method is different from the dyeing method employing the beam dyeing in which the fastener stringer is heated in the dyeing bath and then dyed. Therefore, the attached amount of dye may not be evenly distributed on a smooth surface of the fastener element, or a part of the dye may be peeled off during a period when the fastener stringer is immersed in the dyeing bath and not yet subjected to the thermal treatment. Specifically, since the continuous fastener element is formed of the synthetic resin monofilament, the dye does not permeate the monofilament only by coating the dye on the surface. Therefore, there may be a strong possibility that the dyeing irregularities and the dyeing defects are caused.

In addition, in a case where the fastener element is colored using the inkjet scheme, for example, the blown ink droplets are soaked in and fixed to fibers, so that a desired pattern may be finely formed in the fastener tape. However, when the ink droplets are ejected onto the smooth surface of the fastener element, it is difficult for the ink droplets attached to the element surface to be fixed until the thermal treatment is performed. For this reason, the adjacent ink droplets are mixed to each other, the patterns and the colors are faded, and the outlines are easily blurred. Therefore, the fastener element may not be finely formed in a desired pattern for each fastener tape.

Furthermore, for example, when the continuous fastener element is colored using the pigment-based ink according to the inkjet scheme, since the surface of the monofilament is smooth, when a slider moves slidably, or when the slide fastener comes into conflict with another product, or in similar cases, the pigment-based ink may be peeled off from the fastener element and the color may be separated to fall due to the friction and the impact on the fastener element.

The invention has been made in view of the problems in the related art, and an object is to provide: a fastener stringer, in which a fastener element can be stably colored without color irregularities and dyeing defects when the dyeing method employing the beam dyeing and the continuous dyeing method are used, and to which a desired pattern and a color can be finely attached similarly to the fastener tape when the coloring is performed according to the inkjet scheme; and a slide fastener which includes the fastener stringer.

Means for Solving the Problems

In order to attain the above-mentioned object, the invention provides a fastener stringer for a slide fastener, in which a continuous fastener element formed of a monofilament is attached to a tape side edge portion of a fastener tape and at least a part of the fastener element is subjected to coloration or surface treatment, characterized in that: the fastener element includes a plurality of fine projected rims which are continuously disposed on a peripheral surface of the monofilament along a length direction of the monofilament and a plurality of fine concave grooves which are disposed between the projected rims; and in a cross section of the monofilament, a cross-sectional area of a space region of the concave groove which is defined by connecting apexes of the adjacent projected rims is set to be larger than a cross-sectional area of the projected rim which is defined by connecting bottoms of the adjacent concave grooves.

In the fastener stringer according to the invention, the height of the projected rim is preferably set to 2.5 μm or more and 200 μm or less.

In addition, in the cross section of the monofilament, the diameter of a first virtual circle which is formed by connecting the bottoms of the concave grooves is preferably set to be 80% or more with respect to the diameter of a second virtual circle which is formed by connecting the apexes of the projected rims.

In the fastener stringer according to the invention, in the cross section of the monofilament, the interval between predetermined positions on the projected rims in a circumferential direction is preferably set to 24 μm or more and 200 μm or less.

In addition, the number of the projected rims which are disposed on the peripheral surface of the monofilament is preferably 12 or more and 72 or less.

Furthermore, in the fastener stringer according to the invention, the fastener element includes a coupling head, upper and lower leg portions which extend from the coupling head in a tape width direction, and a connecting portion which connects one of the upper and lower leg portions to one of the upper and lower leg portions of the adjacent fastener elements in a length direction of the fastener tapes. In addition, the projected rims disposed on at least the upper and lower leg portions are preferably crooked with respect to a direction extending from the upper and lower leg portions.

Furthermore, in the fastener stringer according to the invention, in the cross section of the monofilament, a curvature of a concavely curved surface of the concave groove is preferably set to be smaller than that of a convexly curved surface of the projected rim.

Furthermore, in the cross section of the monofilament, at least one of the projected rims is preferably configured such that one curved surface portion which is disposed from an apex to the concave groove on one side is asymmetric to the other curved surface portion which is disposed from the apex to the concave groove on the other side.

In addition, according to the invention, a slide fastener includes a pair of the fastener stringers on left and right sides which are provided with the above-mentioned configurations.

In the slide fastener according to the invention, the projected rims disposed on the upper and lower leg portions of the fastener element are crooked with respect to a direction extending from the coupling head of the upper and lower leg portions. In addition, the crooked directions of the projected rims with respect to the extending direction of the upper and lower leg portions are opposite to each other in the left and right fastener stringers.

Effect of the Invention

A fastener stringer according to the invention is configured such that at least a part of a continuous fastener element formed of a monofilament is subjected to coloration or surface treatment. The continuous fastener element includes a plurality of fine projected rims which are continuously disposed on a peripheral surface of the monofilament along a length direction of the monofilament and a plurality of fine concave grooves which are disposed between the projected rims.

In addition, in the cross section of the monofilament, a cross-sectional area of a space region of the concave groove which is defined by connecting apexes of the adjacent projected rims is set to be larger than that of the projected rim which is defined by connecting bottoms of the adjacent concave grooves. Herein, the projected rim indicates a portion where the outer peripheral surface protrudes in a convex shape in the cross section of the monofilament. The concave groove indicates a portion where the outer peripheral surface is dented in a concave shape in the cross section of the monofilament.

Further, in the invention, the plurality of projected rims and concave grooves which are formed on the upper leg portion or the lower leg portion of the fastener element are preferably disposed in the same direction and in parallel to each other. Herein, strictly speaking, since the fastener element of the invention is formed in a continuous shape, the projected rims are not disposed in parallel in the curved portion of the fastener element. Therefore, the parallel arrangement of the projected rims and the concave grooves means that the projected rims are disposed in substantially parallel mainly in the straight portion of the upper and lower leg portions.

In addition, the invention is not specifically limited to the coloration or the surface treatment to which the fastener element is subjected. Examples of the coloration for the fastener element preferably include a dyeing method employing the beam dyeing, the continuous dyeing method, and a coloring method using dye-based ink or pigment-based ink according to the inkjet scheme. Otherwise, there may employ coating treatment which is carried out through a blowing process. On the other hand, examples of the surface treatment to which the fastener element is subjected may include treatment of forming a thin film such as a deposition process and treatment of bonding a sheet-like film through a thermal transfer process.

As described above, in the continuous fastener element, since the plurality of projected rims which are configured to be continuously formed along the length direction of the monofilament and the plurality of concave grooves are disposed in the peripheral surface of the monofilament, the concave grooves can be uniformly provided in the entire peripheral surface of the monofilament. In addition, since the respective projected rims and the respective concave grooves are configured to be continuously disposed along the length direction of the monofilament (specifically, in a parallel direction to be the same direction), it is possible to prevent the monofilament from being locally degraded in strength in the length direction of the monofilament.

Furthermore, the projected rims are configured to be continuously disposed along the length direction of the monofilament. Therefore, for example, when the slide fastener is composed and the slider moves along the slider fastener, the resistance between the slider and the fastener element can be prevented from being changed when the slider moves. Accordingly, the operability of the slide fastener is not hindered.

In addition, in the fastener stringer according to the invention, the concave grooves including the space region with a large cross-sectional area are disposed in the peripheral surface of the fastener element along the length direction of the monofilament. Therefore, for example, when the fastener element is dyed using a dyeing method employing the beam dyeing, even when the dyeing process is performed in a state where the fastener stringer is wound around the beam in an overlapping manner, the dye can smoothly spread all over the fastener element through the concave grooves. Accordingly, it is possible to uniformly dye the fastener stringer with a desired color without causing the dyeing irregularities and the dyeing defects in the fastener element.

Furthermore, since the concave grooves including the space region with a large cross-sectional area are disposed in the peripheral surface of the fastener element, for example, when the fastener element is dyed using the continuous dyeing method, the dye can be received in the respective concave grooves and thus stably retained. With this configuration, it is possible to prevent defects such as disproportion in amount of the dye attached on the surface of the fastener element, and partially falling of the dye until the thermal treatment after being immersed into the dyeing bath. Therefore, it is possible to uniformly dye the fastener stringer with a desired color without causing the dyeing irregularities and the dyeing defects in the fastener element.

In addition, since the concave grooves including the space region with a larger cross-sectional area are disposed in the peripheral surface of the fastener element, for example, when the fastener element is colored using the inkjet scheme, the ink droplets ejected on the surface of the fastener element is received in the concave grooves. Therefore, it is possible to stably fix the attached ink droplets to the surface of the element.

With this configuration, the adjacent ink droplets attached to the surface of the element can be prevented from being mixed to each other. Therefore, the pattern of the fastener element is prevented from being blurred (the outlines of the patterns and the colors become cloudy), and thus it is possible to form the outlines of the patterns to be clear. Therefore, it is possible to finely form a desired pattern on the fastener element, as in the fastener tape.

Furthermore, for example, even when the continuous fastener element is colored using the pigment-based ink through the inkjet scheme, the pigment-based ink can be received in the respective concave grooves formed on the surface of the fastener element and thus stably retained in the surface of the fastener element. With this configuration, for example, in a case such as when the slider moves, when the slide fastener comes into conflict with another product, and similar cases, it is possible to effectively suppress that the pigment-based ink is peeled off from the fastener element due to the friction and the impact on the fastener element.

In addition, since the concave grooves including the space region with a large cross-sectional area are disposed in the peripheral surface of the fastener element, for example, when the fastener element is subjected to the coloration in which a coating is carried out by a blowing process or to the surface treatment which includes treatment of forming a thin film such as the vacuum deposition process and treatment of bonding a sheet-like film through the thermal transfer process, it is possible to increase adhesiveness or fixability between the surface of the fastener element and the thin film (including the coating film and the like) formed on the surface or the film boned on the surface. Therefore, it is difficult to peel out the thin film or the film disposed on the fastener element, and the quality of the fastener stringer can be stably maintained for a long time.

In the fastener stringer according to the invention, the height of the projected rim is set to 2.5 μm or more and 200 μm or less. In a case where the height of each projected rim is set to 2.5 μm or more, the concave groove is formed deep, and the large cross-sectional area of the space region of the concave groove can be secured.

With this configuration, in a case of performing the dyeing process employing the beam dyeing, the dye can smoothly spread all over the fastener element through the concave grooves. In addition, in a case of performing the continuous dyeing method, the dye can be certainly received in the respective concave grooves. Furthermore, in a case of performing a coloring according to the inkjet scheme, the ink droplets can be certainly received in and fixed to the respective concave grooves.

On the other hand, in a case where the height of each projected rim is set to 200 μm or less, it is possible to stably obtain strength with which the fastener element (the monofilament) can be durably used as the slide fastener. In addition, the surface of the element is prevented from being jagged when the fastener element is observed.

In this case, in the cross section of the monofilament, the diameter of a first virtual circle which is formed by connecting the bottoms of the concave grooves is set to be 80% or more with respect to that of a second virtual circle which is formed by connecting the apexes of the projected rims, and preferably 90% or more.

With this configuration, it is possible to stably obtain strength with which the fastener element (the monofilament) can be durably used as the slide fastener. Further, a ratio of the diameter of the first virtual circle to the diameter of the second virtual circle is not specifically limited. However, in order to appropriately secure the size of the cross-sectional area of the space region of the concave groove, the diameter of the first virtual circle is preferably set to be 99% or less with respect to that of the second virtual circle.

Herein, the first and the second virtual circles, as described above, are virtual circles which are formed by connecting the bottoms of the concave grooves and the apexes of the projected rims, respectively. The first and the second virtual circles are preferably formed by connecting the bottoms of the entire concave grooves and the apexes of the entire projected rims. However, in a case where it is impossible to form the virtual circles connecting the bottoms of the entire concave grooves and the apexes of the entire projected rims, the first virtual circle or the second virtual circle may be set to a circle which is virtually approximated such that the interval between the bottoms of the entire concave grooves or the apexes of the entire projected rims becomes minimal.

In the fastener stringer according to the invention, in the cross section of the monofilament, the interval between predetermined positions of the respective projected rims in the circumferential direction is set to 24 μm or more and 200 μm or less. Herein, the interval between the predetermined positions of the respective projected rims in the circumferential direction, for example, refers to an interval between the apexes of the respective projected rims in the circumferential direction, or an interval between ends (skirt portions) on one side of the respective projected rims in the circumferential direction, which indicates a so-called pitch of the projected rims. Since the interval between the respective projected rims is set to 24 μm or more and 200 μm or less, it is possible to appropriately secure the size of the space region of the concave groove which is disposed between the respective projected rims.

In addition, the number of projected rims disposed in the peripheral surface of the monofilament is set to 12 or more and 72 or less, and preferably 12 or more and 48 or less. With this configuration, the concave grooves can be provided in the entire peripheral surface of the monofilament at an appropriate interval. Therefore, in a case of performing the dyeing process employing the beam dyeing, the dye can smoothly spread all over the fastener element through the concave grooves. In addition, in a case of performing the continuous dyeing method, the dye can be certainly received in the respective concave grooves. Furthermore, in a case of performing a coloring according to the inkjet scheme, the ink droplets can be certainly received in and fixed to the respective concave grooves.

Furthermore, in the fastener stringer according to the invention, the fastener element includes a coupling head, upper and lower leg portions which extend from the coupling head in a tape width direction, and a connecting portion which connects one of the upper and lower leg portions to one of the upper and lower leg portions of the adjacent fastener elements in a length direction of the fastener tapes. In addition, the projected rims disposed on at least the upper and lower leg portions are crooked (inclined) with respect to a direction extending from the upper and lower leg portions.

As described above, since the projected rims and the concave grooves between the projected rims are disposed to be crooked with respect to the expending direction of the upper and lower leg portions, the concave grooves are disposed to wind the peripheral surface of the monofilament. With this configuration, for example, when the fastener stringer is subjected to the dyeing process employing the beam dyeing, the fastener stringer is wound around the beam in an overlapping manner, so that the surface of the fastener element wound in each layer comes into close contact with the rear surface of the fastener tape wound in the next layer. Even in this state, the dye can spread through the concave grooves, which are disposed to be crooked, onto the surfaces of the fastener element in close contact with each other. Therefore, the entire fastener element can be stably dyed.

In addition, in the fastener stringer according to the invention, in the cross section of the monofilament, the curvature of a concavely curved surface of the concave groove is set to be smaller than that of the convexly curved surface of the projected rim. With this configuration, the concave groove can be formed wide in the circumferential direction. Therefore, in a case of performing the dyeing process employing the beam dyeing, the dye can stably spread through the concave grooves onto the entire fastener element. In addition, in a case of performing the continuous dyeing method, the dye can be received in the respective concave grooves to be stably retained. Furthermore, in a case of performing a coloring according to the inkjet scheme, the ink droplets are received in the respective concave grooves to be stably fixed. In addition, in a case where the curvature of the concavely curved surface of the concave groove is smaller than that of the convexly curved surface of the projected rim, even when the concave groove is formed wide in the circumferential direction, the depth of the concave groove can be relatively reduced. Therefore, the strength of the monofilament can be stably secured.

Furthermore, in the cross section of the monofilament, at least one of the projected rims is configured such that one curved surface portion disposed from the apex to the concave groove on one side is asymmetrically formed to the other curved surface portion disposed from the apex to the concave groove on the other side. Since the fastener stringer according to the invention is configured such that the plurality of projected rims and concave grooves are disposed in the peripheral surface of the fastener element as described above, the projected rims and the concave grooves diffusely reflect light, so that it is possible to make the gloss of the monofilament degraded or faded away. Specifically, at least one of the projected rims is configured to be asymmetrically formed with the apex as the center so as not to uniformly reflect the light on one curved surface portion and the other curved surface portion of the projected rim. Therefore, the light can be diffusely-reflected more effectively, so that it is possible to make the gloss of the monofilament degraded or faded away.

Further, the slide fastener according to the invention which includes a pair of the left and right fastener stringers provided with the above-mentioned configurations is configured such that the plurality of fine projected rims continuously and the plurality of fine concave grooves formed along the length direction of the monofilament are disposed in the peripheral surface of the monofilament. In addition, in the cross section of the monofilament, the cross-sectional area of the space region of each concave groove is set to be larger than that of each projected rim.

In the slide fastener according to the invention, since the fastener stringer or a fastener chain is subjected to the dyeing process employing the beam dyeing or to the dyeing process according to the continuous dyeing method, it is possible to prevent the dyeing irregularities and the dyeing defects from being arisen in the fastener element, and the slide fastener is improved in visibility. In addition, the slide fastener is improved in visibility by performing the coloration using the inkjet scheme on the fastener stringer or the fastener chain to finely form the outlines of the patterns of the fastener element.

In addition, in the slide fastener according to the invention, the projected rims disposed in the upper and lower leg portions of the fastener element are disposed to be crooked with respect to the extending direction from the coupling head of the upper and lower leg portions. Further, the crooked directions of the projected rims with respect to the extending direction of the upper and lower leg portions are opposite to each other in the left and right fastener stringers. Therefore, when the slide fastener is colored, since the left and right fastener stringers are in a symmetric relation, it is possible to suppress uncomfortable feeling in visibility between the left and right fastener stringers.

MODE(S) FOR CARRYING OUT THE INVENTION

Hereinafter, an embodiment of the invention will be described in detail with reference to the drawings. Further, the invention is not limited to the embodiment to be described below, and various changes may be made as long as the configurations are substantially the same as those of the invention and similar advantages are obtained.

For example, a continuous fastener element to be described in the embodiment below is formed by forming a monofilament in a coil shape. However, the invention is not limited to the shape, and the continuous fastener element may be formed of the monofilament in a zigzag shape.

Figure 1:
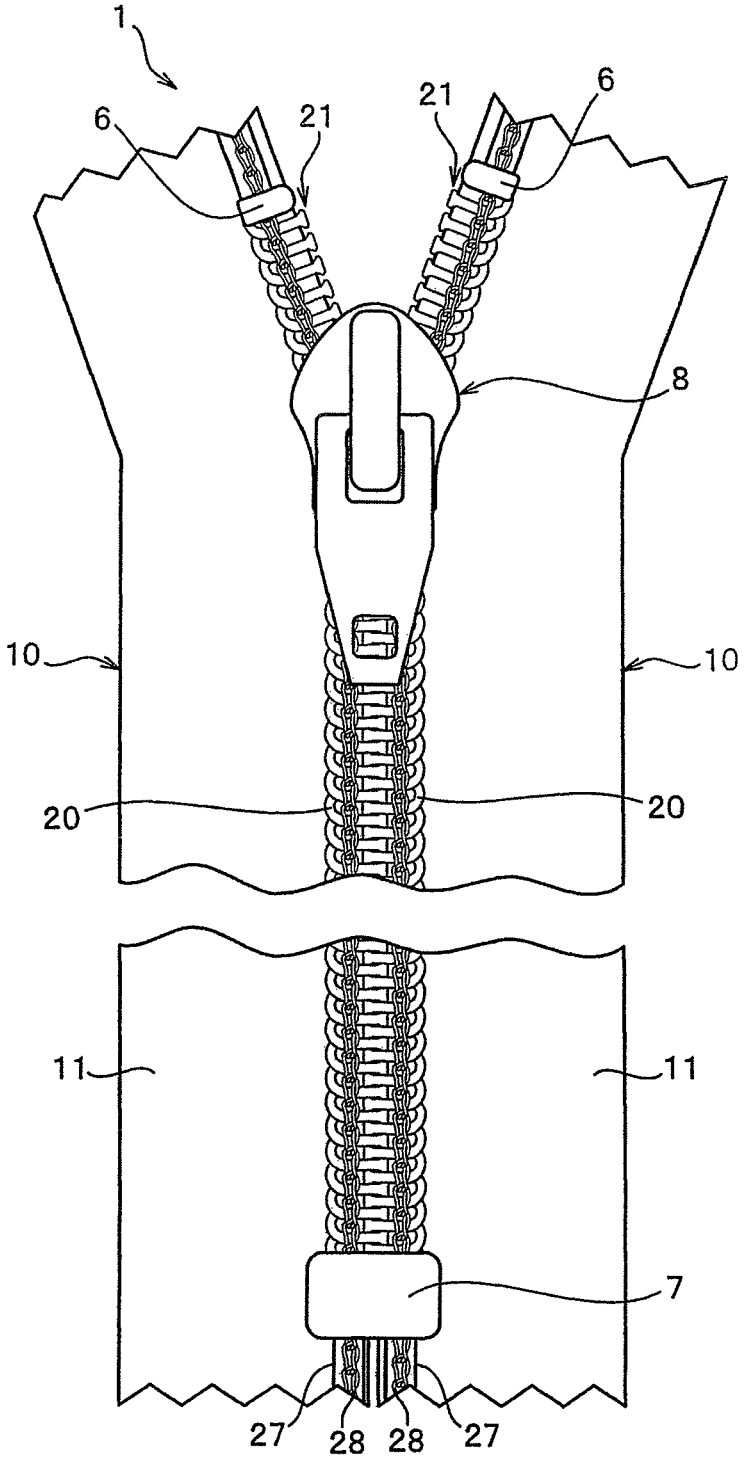
FIG. 1 is a front view illustrating a slide fastener according to an embodiment of the invention.
Figure 2:
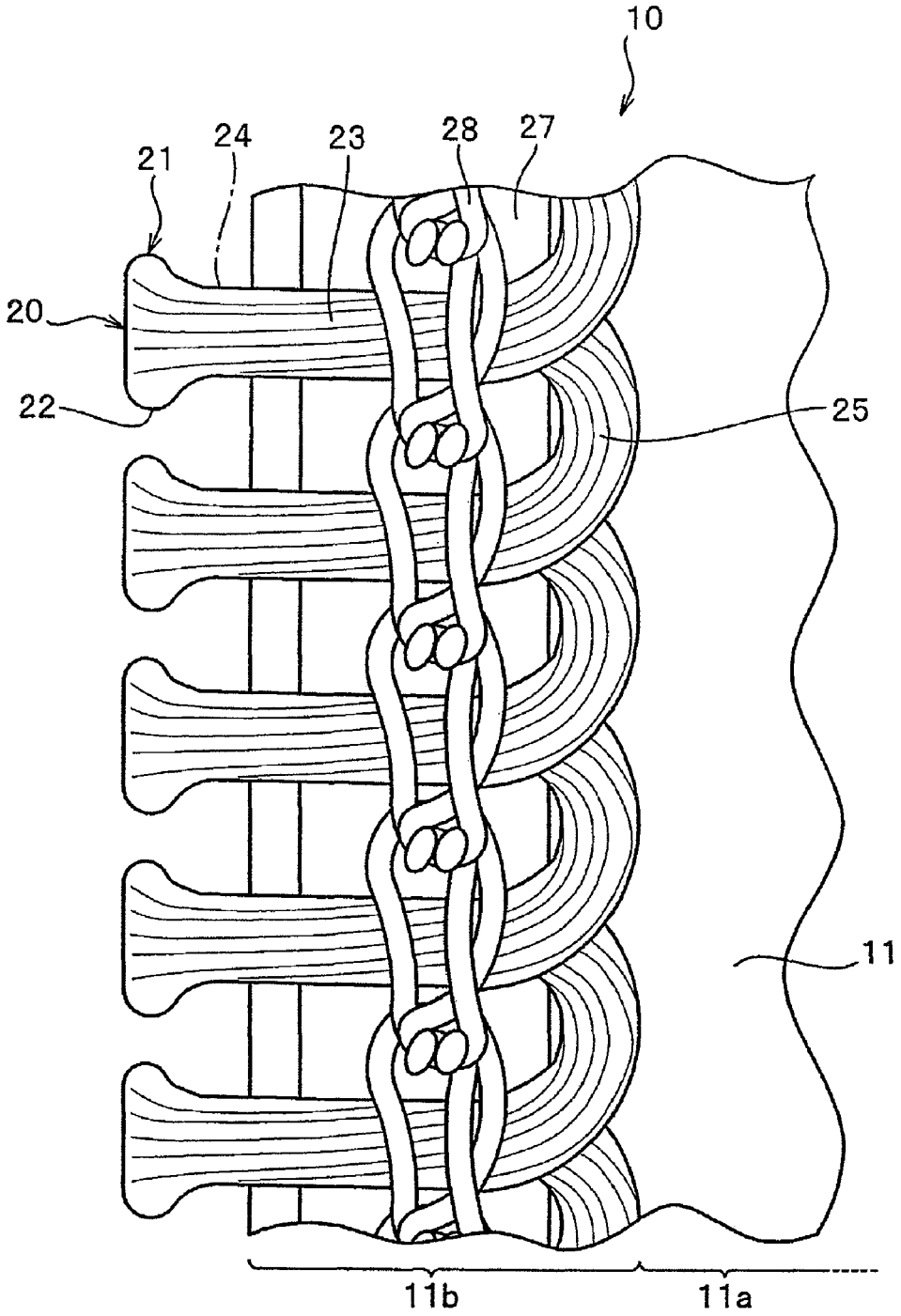
FIG. 2 is an enlarged view illustrating a relevant part of the slide fastener.
Figure 3:
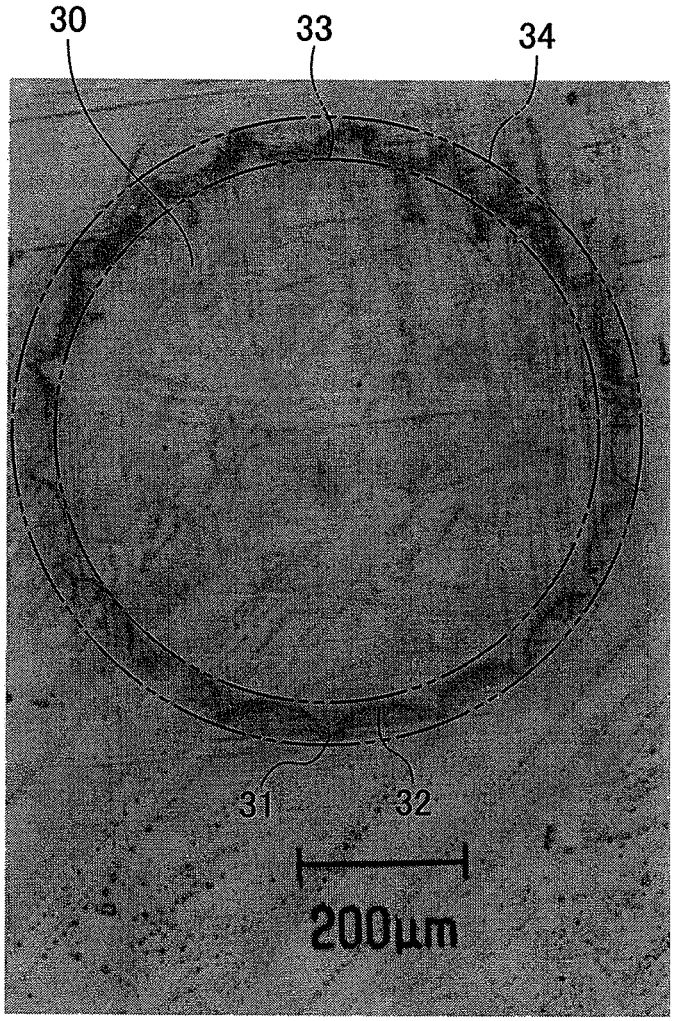
FIG. 3 is a cross-sectional view illustrating an upper leg portion of a fastener element of the slide fastener.
Figure 4:
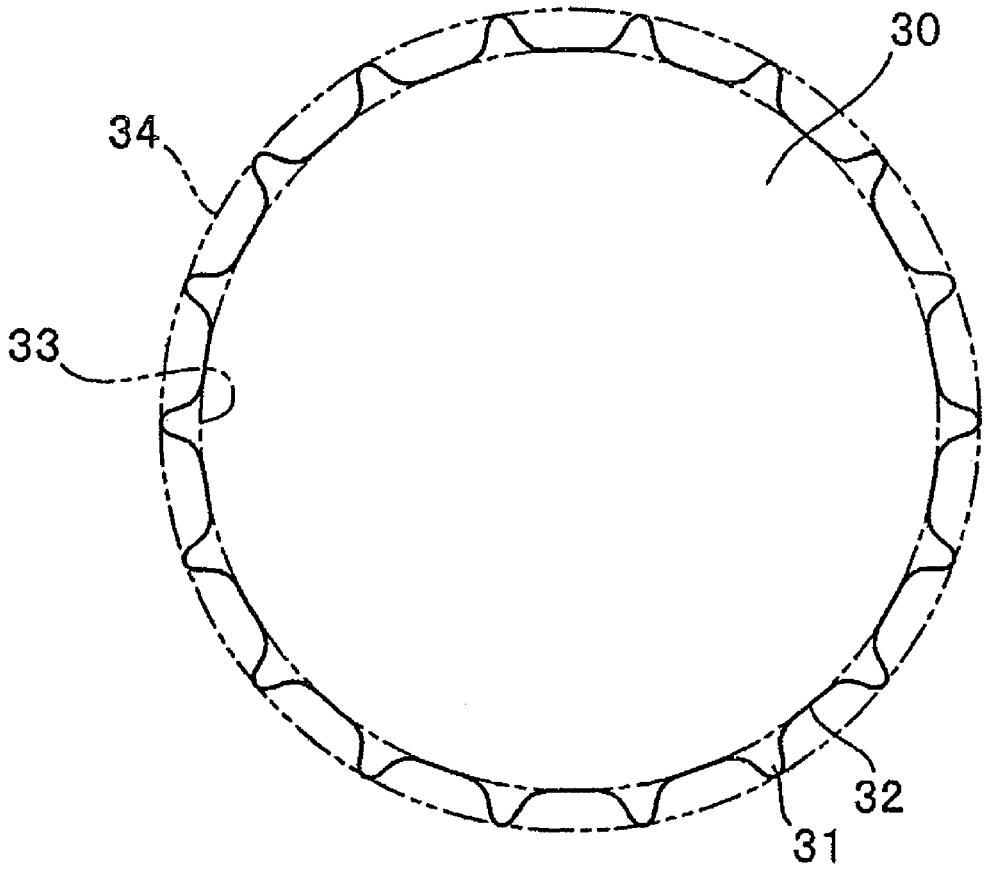
FIG. 4 is a schematic view illustrating a cross section of the upper leg portion.
Figure 5:
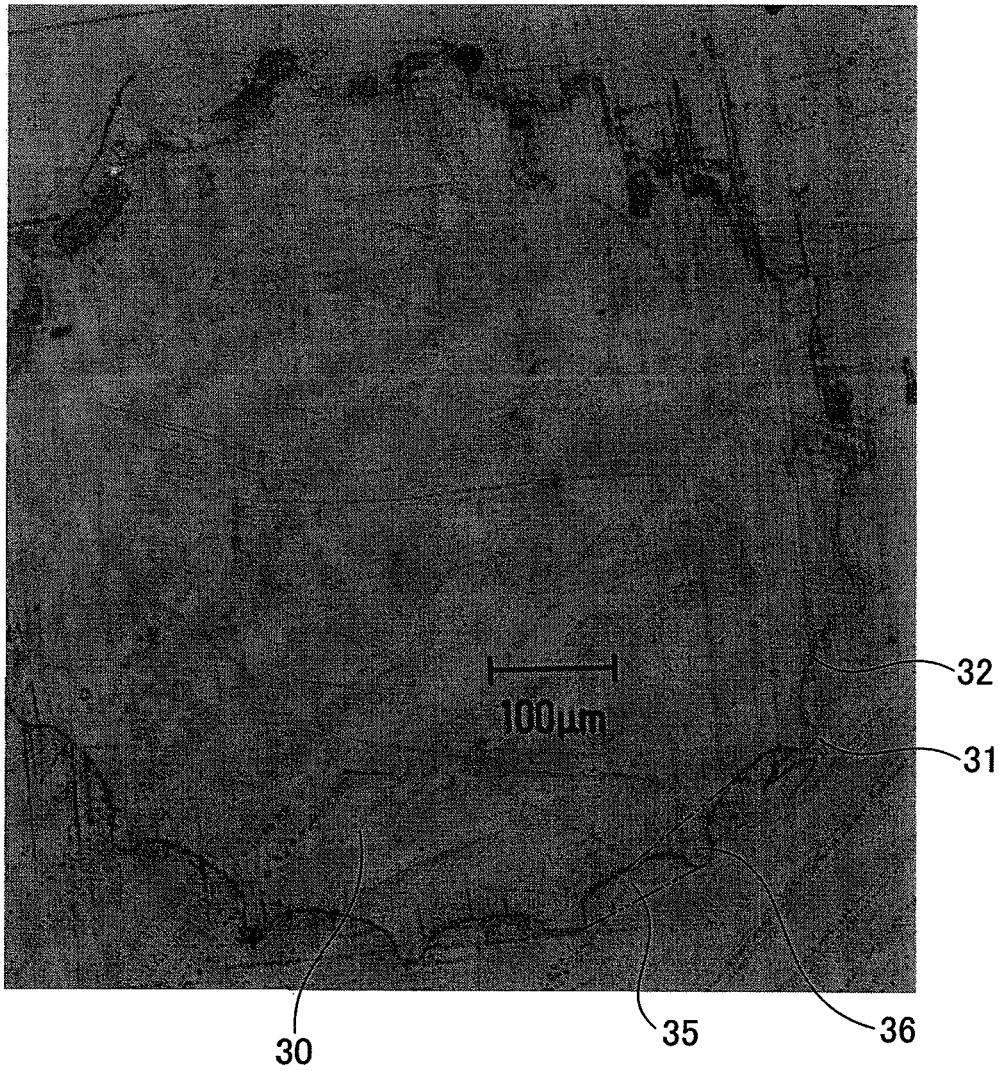
FIG. 5 is an enlarged cross-sectional view illustrating the cross section of the upper leg portion of the fastener element.
Figure 6:
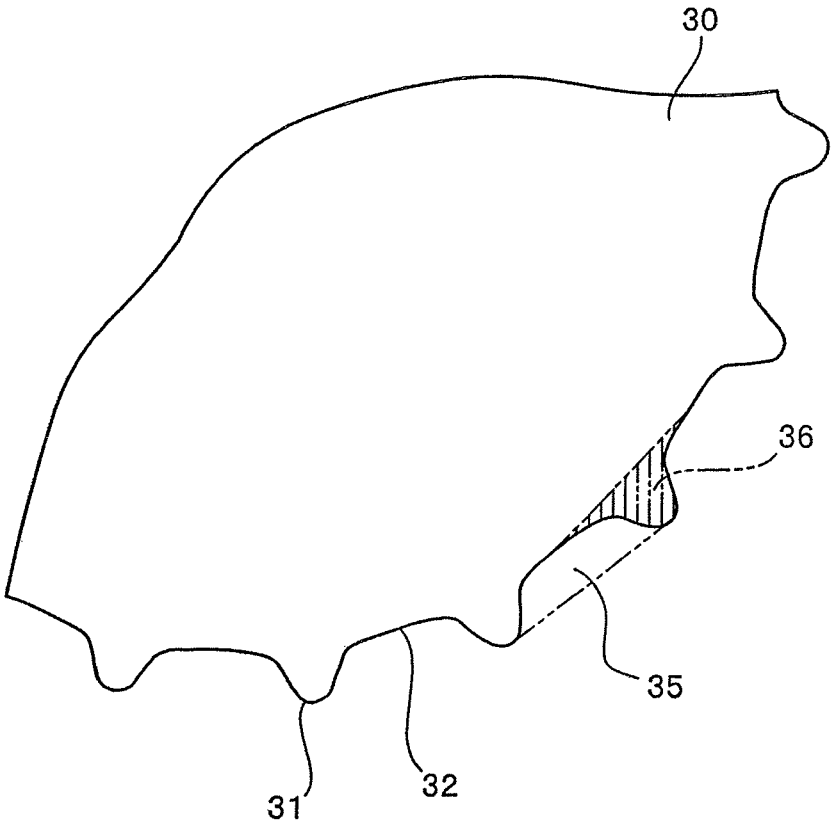
FIG. 6 is a schematic view illustrating a cross section of a relevant part of the upper leg portion.

Herein, FIG. 1 is a front view illustrating a slide fastener according to the embodiment, and FIG. 2 is an enlarged view illustrating a relevant part of the slide fastener. In addition, FIG. 3 is a cross-sectional view illustrating an upper leg portion of a fastener element of the slide fastener, and FIG. 4 is a schematic view illustrating a cross section of the upper leg portion. Furthermore, FIG. 5 is an enlarged cross-sectional view illustrating the cross section of the upper leg portion of the fastener element, and FIG. 6 is a schematic view illustrating a cross section of a relevant part of the upper leg portion. Further, in FIGS. 4 and 6, the cross section is depicted in blank without hatching in order to make the feature of the invention easily recognizable.

In addition, in the following description, a front and rear direction indicates a length direction of a fastener tape, which is the same direction as a sliding direction of a slider. In addition, a left and right direction indicates a tape width direction of the fastener tape, which is a direction parallel to a tape surface of the fastener tape and perpendicular to a tape length direction. Furthermore, an upper and lower direction indicates a back and front direction of the tape perpendicular to the surface of the fastener tape. In particular, a portion on the surface of the fastener tape to which fastener elements are attached is defined as an upper portion, and the opposite portion is defined as a lower portion.

A slide fastener 1 according to the embodiment includes a pair of left and right fastener stringers 10, top stops 6 each of which are fixed on one end side of element rows 21 of the fastener stringers 10, bottom stop 7 which is fixed on the other side of the element rows 21 of the fastener stringers 10, and a slider 8 which is slidably attached along the element row 21.

The slide fastener 1 is a so-called standard type of slide fastener, in which the left and right element rows 21 are coupled by sliding the slider 8 toward the top stops 6 to close the slide fastener 1, and the left and right element rows 21 are separated by sliding the slider 8 toward the bottom stop 7 to open the slide fastener 1. Further, the top stops 6, the bottom stop 7, and the slider 8 in the slide fastener 1 are configured as similar as those typically used in the related art.

The left and right fastener stringers 10 included in the above-mentioned slide fastener 1 include fastener tapes 11 which are woven in a narrow shape and the element rows 21 which are arranged along tape side edge portions 11*b* of the fastener tapes 11. The element row 21 is configured such that continuous fastener element 20 formed in a coil shape is sewn on the fastener tape 11 by making the double chain stitch with a sewing yarn 28 in a state where a core thread 27 is passed through between upper and lower leg portions 23 and 24 as to be described below. Further, the element row 21 in the invention may be configured by sewing the fastener element 20 on the fastener tape 11 without providing the core thread 27.

The fastener tape 11 of the embodiment includes a tape body portion 11*a* which is sewn on fastener attached products such as clothes and bags, and the tape side edge portion 11*b* (which may be called an element attaching section) which is disposed on one side edge of the tape body portion 11*a* to be attached to the fastener element 20.

Further, the fastener tape 11 of the embodiment is formed in a fabric structure, but the invention is not limited to the configuration of the fastener tape 11. For example, materials and thicknesses of a warp yarn and a weft yarn forming the fastener tape 11 can be selected arbitrarily. In addition, the fastener tape 11 may be configured in a knitting structure.

The fastener element 20 of the embodiment has a continuous coil shape, and is configured with a monofilament 30 formed of a thermoplastic resin such as polyamide or polyester, which will be described below. Further, the fastener element 20 of the embodiment is subjected to a dyeing process such as a beam dyeing or a continuous dyeing, or a coloration process performed by an inkjet scheme, as to be described below. In this case, the color of the fastener element 20 before these coloration methods is not particularly limited. In addition, the fastener element 20 may be formed of a transparent material. For example, in the case where the fastener element 20 is transparent, when all the fastener elements 20 are colored with the same color, the color of the fastener element 20 can be raised further uniformly.

The fastener element 20 includes a coupling head 22 which is formed to protrude in the front and rear direction (the length direction of the fastener tape 11), a pair of the upper and lower leg portions 23 and 24 which are extended from the coupling head 22 toward the inner side of the tape in the tape width direction, and a connecting portion 25 which connects an extension end part of the upper leg portion 23 or the lower leg portion 24 to the lower leg portion 24 or the upper leg portion 23 of the adjacent fastener element 20 in the front and rear direction.

Further, for example, in a case where the fastener element is formed in a zigzag shape, the fastener element in the zigzag shape includes a coupling head, a pair of upper and lower leg portions which are extended from the coupling head toward the inner side of the tape in the tape width direction, and a connecting portion which connects adjacent fastener elements in the front and rear direction. The upper leg portion of each fastener element is connected to the upper leg portion of the adjacent fastener element in the front direction or the rear direction through the connecting portion. In addition, the lower leg portion of each fastener element is connected to the lower leg portion of the adjacent fastener element in the rear direction or the front direction through the connecting portion. In this case, the fastener tape is positioned between the upper leg portion and the lower leg portion of the fastener element.

In addition, the peripheral surface of the fastener element 20 is provided with a plurality of projected rims 31 which are convexly provided along the length direction of the monofilament 30, forming the fastener element 20, in a continuous manner, and a plurality of concave grooves 32 each of which are recessively provided between the projected rims 31. The plurality of projected rims 31 and concave grooves 32 are disposed in parallel to each other.

Further, the shapes of the projected rim 31 and the concave groove 32 according to the invention are not particularly limited. For example, in a case where the outer peripheral surfaces of the projected rim 31 and the concave groove 32 are an angulated shape in cross-sectional view of the monofilament 30, the projected rim 31 may be easily worn out by friction with the slider 8 and the slider 8 may be easily hindered by the fastener element 20. Therefore, since there is a concern that the slider 8 is degraded in slidability, it is preferable that the outer peripheral surfaces of the projected rim 31 and the concave groove 32 be formed in a curved surface shape.

Herein, in cross-sectional view of the monofilament 30, a point or a portion of each projected rim 31 farthest away from the center of the monofilament 30 in a radial direction is defined as an apex of the projected rim 31. In other words, the apex of the projected rim 31 is a tip end of the projected rim 31, and corresponds to a position with the largest dimension from the center of a first virtual circle 33 or a second virtual circle 34 which can be obtained by virtually drawing in the cross section of the monofilament 30 as to be described below.

On the other hand, in the concave groove 32, a point or a portion nearest to the center of the monofilament 30 in the radial direction is defined as a bottom of the concave groove 32. In this case, the bottom of the concave groove 32 may be defined by approximating an intersection between the concave groove 32 and the straight line passing through a midpoint of a line connecting two adjacent apexes of the projected rims 31 and the center of the first virtual circle 33 or the second virtual circle 34 in the radial direction in the cross section of the monofilament 30.

In the embodiment, a maximum diameter of the monofilament 30 forming the fastener element 20 is set to 0.74 mm. Herein, the maximum diameter of the monofilament 30 refers to a diameter of the second virtual circle 34 which is formed by connecting the apexes of the respective projected rims 31 as to be described below.

In addition, for example, as illustrated in cross-sectional view of the monofilament 30 of the upper leg portion 23 in FIGS. 3 to 6, the peripheral surface of the monofilament 30 is provided with eighteen projected rims 31 at a substantially equal interval. In addition, an interval between the apexes of the projected rims 31 in the circumferential direction (hereinafter, the interval will be referred to as a pitch of the projected rims 31) is set to 24 μm or more and 200 μm or less. For example, an average pitch of the projected rims 31 of the monofilament 30 may be 129 μm.

Further, when the fastener element 20 is formed, the shape of the projected rim 31 may be deformed to be dented as to be described below. Therefore, the apex point may not be clearly distinguished based on the shape of the projected rim 31. In this case, an average pitch of the projected rims 31 may be obtained such that a circumference is calculated based on the maximum diameter of the monofilament 30 and divided by the number of projected rims 31. The average pitch of the projected rims 31 is preferably 24 μm or more and 200 μm or less.

In addition, in the cross section of the monofilament 30, the dimension of one concave groove 32 in the circumferential direction is set to be larger than that of one projected rim 31 in the circumferential direction. In this way, when the dimension of the concave groove 32 in the circumferential direction is formed to be larger than that of the projected rim 31, each concave groove 32 may stably retain dye or may be stable for fixing ink.

Herein, the dimension of the concave groove 32 in the circumferential direction is a dimension of the concave groove 32 covering a range where a concavely curved surface is formed in the circumferential direction. The dimension of the projected rim 31 in the circumferential direction is a dimension of the projected rim 31 covering a range where a convexly curved surface is formed in the circumferential direction. In this case, a boundary between the projected rim 31 and the concave groove 32 is defined as an inflection point where the outer peripheral surface changes from the convexly curved surface to the concavely curved surface.

Further, for example, in a case where the projected rim 31 is dented to crush the projected rim 31 as to be described below, an ark-like curved line is virtually drawn to approach the outer peripheral surfaces of the projected rim 31 and the concave groove 32 in a cross-sectional picture of the monofilament 30, so that the dimensions of the projected rim 31 and the concave groove 32 in the circumferential direction may be obtained based on the virtual curved line.

In the fastener element 20, the height of each projected rim 31 is set to fall within a range of 2.5 μm or more and 200 μm or less. In addition, an average height of all the projected rims 31 is set to fall within a range of 5 μm or more and 100 μm or less. In practice, in a case where the maximum diameter of the monofilament 30 is set to 0.74 mm as described in the embodiment, the height of each projected rim 31 may be set to fall within a range of 5 μm or more and 150 μm or less (in particular, 5 μm or more and 50 μm or less). Then, the average height of all the projected rims 31 may be set to 10 μm.

In this way, with the configuration of each projected rim 31 having a height of 2.5 μm or more, the concave groove 32 can be formed deep. Therefore, a large cross-sectional area 35 of a space region of the concave groove 32 can be secured as to be described below. On the other hand, with the configuration of each projected rim 31 having a height of 200 μm or less, an appropriate cross-sectional area (that is, a cross-sectional area of a region inside the circumference regions of the projected rim 31 and the concave groove 32 in the monofilament 30) can be secured to ensure the strength of the monofilament 30. Therefore, it is possible to stably obtain strength with which the fastener element 20 is durably used as the slide fastener 1.

In addition, with the configuration of the projected rim 31 having a height of 200 μm or less, the element surface is prevented from being jagged or rough when the fastener element 20 is observed. Furthermore, with the configuration of the projected rim 31 made lowered in height, when the left and right fastener elements 20 of the slide fastener 1 are coupled, the left and right coupling heads 22 can be smoothly coupled to each other and a predetermined chain strength can be obtained.

In the invention, the height of the projected rim 31 is measured as follows: a first virtual line is drawn first to connect two adjacent apexes of the projected rims 31 in the cross section of the monofilament 30, and a point farthest away from the virtual line is determined as a reference point in the concave groove 32 disposed between both the projected rims 31. Next, a circle is drawn to pass the reference point around the center of the cross section of the monofilament 30; a tangent is drawn at the reference point; and a second virtual line is drawn to be parallel to the tangent to pass the apexes of the projected rims 31. Then, the height of the projected rim 31 is obtained by measuring a dimension between the tangent and the second virtual line.

In addition, in the cross section of the monofilament 30 of the upper and lower leg portions 23 and 24, the diameter of the first virtual circle 33 which is formed by connecting the bottoms of the respective concave grooves 32 is set to be 80% or more with respect to that of the second virtual circle 34 which is formed by connecting the apexes of the respective projected rims 31, and preferably 90% or more.

In particular, in the case of the embodiment, the diameter of the first virtual circle 33 which is formed by connecting the bottoms of the respective concave grooves 32 is 0.72 mm. Further, the diameter (the maximum diameter of the monofilament 30) of the second virtual circle 34 which is formed by connecting the apexes of the respective projected rims 31 is 0.74 mm. Therefore, a ratio of the diameter of the first virtual circle 33 to the diameter of the second virtual circle 34 is set to 97%.

Furthermore, as illustrated in FIGS. 5 and 6, the cross-sectional area 35 of the space region of each concave groove 32 is defined by virtually connecting the adjacent apexes of the projected rims 31, and is set to be larger than a cross-sectional area 36 of each projected rim 31 (an area of a hatched portion in FIG. 6) which is defined by virtually connecting the bottoms of the adjacent concave grooves 32.

Further, the cross-sectional area 35 of the space region of each concave groove 32 is preferably formed to be larger than the cross-sectional area 36 of each projected rim 31. However, in the invention, the case where the cross-sectional area of the space region of the concave groove is formed to be larger than the cross-sectional area of the projected rim includes a case where the cross-sectional area 35 of the space regions of a predetermined number of concave grooves 32 is formed to be larger than the cross-sectional area 36 of a predetermined number of projected rims 31, and a case where an average value of the cross-sectional area 35 of the space region of each concave groove 32 is formed to be larger than that of the cross-sectional area 36 of the projected rim 31.

As described above, the fastener element 20 of the embodiment is configured such that the height of each projected rim 31 is regulated in a predetermined range, and the ratio of the diameter of the first virtual circle 33 to the diameter of the second virtual circle 34 reaches up to 97%. Therefore, even though the plurality of concave grooves 32 having the space regions as described above are formed in the peripheral surface of the monofilament 30, it is possible to appropriately secure the strength of the monofilament 30 with which the fastener element is durably used as the slide fastener 1. In addition, the fastener elements 20 are configured such that the respective projected rims 31 and the respective concave grooves 32 are disposed in parallel to each other. Therefore, the strength of the monofilament 30 is prevented from being locally degraded in the length direction of the monofilament 30.

The fastener element 20 of the embodiment is configured such that, when the shapes of the projected rim 31 and the concave groove 32 are viewed in the cross section of the monofilament 30, the curvature of the concavely curved surface of at least one concave groove 32 of the entire concave grooves 32 is set to be smaller than the curvature of the convexly curved surface of the projected rim 31 adjacent to the concave groove 32. Further, the curved surface of the concave groove 32 is gently formed rather than the curved surface of the projected rim 31.

With this configuration, the concave groove 32 can be formed wide in the circumferential direction. Therefore, each concave groove 32 may stably retain the dye, or may be stable for fixing ink. In this case, even though the concave groove 32 is formed wide in the circumferential direction, the depth of the concave groove 32 can be relatively reduced. Accordingly, it is possible to stably secure the strength of the monofilament 30.

Further, for example, in a case where the projected rim 31 is dented to crush the projected rim 31 as to be described below, an ark-like curved line is virtually drawn to approach the outer peripheral surfaces of the projected rim 31 and the concave groove 32 in a cross-sectional picture of the monofilament 30, so that the curvature of the convexly curved surface of the projected rim 31 and the curvature of the concavely curved surface of the concave groove 32 may be obtained based on the virtual curved line.

In this case, in the cross section of the monofilament 30, at least one of the projected rims 31 disposed on the peripheral surface of the monofilament 30 is configured such that one curved surface portion disposed from the apex to the concave groove 32 on one side in the circumferential direction is asymmetrically formed to the other curved surface portion which is disposed from the apex to the concave groove 32 on the other side in the circumferential direction.

The fastener stringer 10 of the embodiment is configured such that the plurality of projected rims 31 and the plurality of concave grooves 32 are disposed on the peripheral surface of the fastener element. With this configuration, since the projected rims 31 and the concave grooves 32 diffusely reflect light, it is possible to make the gloss of the monofilament degraded or faded away. Specifically, when the projected rim 31 is asymmetrically formed with the apex as the center in cross-sectional view of the monofilament 30 as described above, light is differently reflected on one curved surface portion and on the other curved surface portion of the projected rim 31, thereby being capable of diffusely-reflecting the light more effectively. Therefore, the gloss of the monofilament 30 may be degraded furthermore, or certainly faded away.

In addition, in the fastener element 20 of the embodiment, as illustrated in FIG. 2, an arrange direction of the projected rims 31 and the concave grooves 32 disposed on the upper and lower leg portions 23 and 24 is crooked (inclined) with respect to the tape width direction that is an extending direction of the upper and lower leg portions 23 and 24.

Particularly, in the case of the embodiment, in front view of the slide fastener 1 (see FIG. 1), the arrangement of the projected rims 31 and the concave grooves 32 disposed on the upper and lower leg portions 23 and 24 is crooked from the coupling head 22 toward the connecting portion 25 with an inclination to the front direction (toward the top stop 6).

Particularly, in the case of the embodiment, in front view of the slide fastener 1 (see FIG. 1), the arrangement of the projected rims 31 and the concave grooves 32 disposed on the upper leg portion 23 is crooked from the coupling head 22 toward the connecting portion 25 with an inclination to the front direction (toward the top stop 6). In this case, the projected rims 31 and the concave grooves 32 disposed on the upper leg portion 23 are crooked to be parallel to each other with an inclination in the same direction.

Although the lower leg portion 24 is not seen in front view of the slide fastener 1 because of its position on the lower side of the upper leg portion 23, when the coil shape of the fastener element 20 is seen in rear view opposite to the front face, the arrangement of the projected rims 31 and the concave grooves 32 disposed on the lower leg portion 24 is crooked from the coupling head 22 toward the connecting portion 25 with an inclination to the front direction (toward the top stop 6).

Further, in the invention, the crooked direction of the projected rims 31 and the concave grooves 32 may be inclined toward a direction opposite to that in Embodiment 1. In other words, in front view of the upper leg portion 23 of the fastener element 20, the projected rims and the concave grooves may be disposed to be crooked from the coupling head 22 toward the connecting portion 25 with an inclination to the rear direction (toward the bottom stop 7).

In the case of the embodiment, the projected rims 31 and the concave grooves 32 disposed on the lower leg portion 24 are crooked to be parallel to each other with an inclination to the same direction. Further, the crooked direction of the projected rims 31 and the concave grooves 32 disposed on the upper and lower leg portions is the same as that in the case of the zigzag shape of the fastener element.

With this configuration, when the left and right fastener elements 20 are coupled to close the slide fastener 1, the projected rims 31 and the concave grooves 32 disposed on the upper and lower leg portions 23 and 24 of the right fastener element 20 are arranged in a direction opposite to the projected rims 31 and the concave grooves 32 disposed on the upper and lower leg portions 23 and 24 of the left fastener element 20, thereby being in a crooked state to be symmetrical to each other.

In other words, when the left and right fastener elements 20 are sewn on the fastener tape 11 to form the left and right fastener stringers 10, the crooked direction of the projected rims 31 and the concave grooves 32 of the fastener element 20 in the left fastener stringer 10 is different from that of the projected rims 31 and the concave grooves 32 of the fastener element 20 in the right fastener stringer 10. Herein, the difference in the crooked direction means that the extension inclined due to the crooked arrangement of the projected rims 31 or the concave grooves 32 disposed on the upper and lower leg portions 23 and 24 of one fastener element 20 is intersected with the extension inclined due to the crooked arrangement of the projected rims 31 or the concave grooves 32 disposed on the upper and lower leg portions 23 and 24 of the other fastener element 20, with an angle formed between the two extensions. Further, for example, in a case where the projected rims 31 or the concave grooves 32 are disposed to be crooked with an ark-like inclination, the inclined extension may be obtained by taking a tangent on the ark-like inclination.

Next, a method of manufacturing the fastener stringer 10 according to the embodiment will be described.

First, the fastener tape 11 and the fastener element 20 are prepared. The fastener tape 11, for example, is woven in a predetermined fabric structure using a weaving machine which makes a carrier bar reciprocate into openings formed between the warp yarns to insert the weft yarns.

Figure 7:
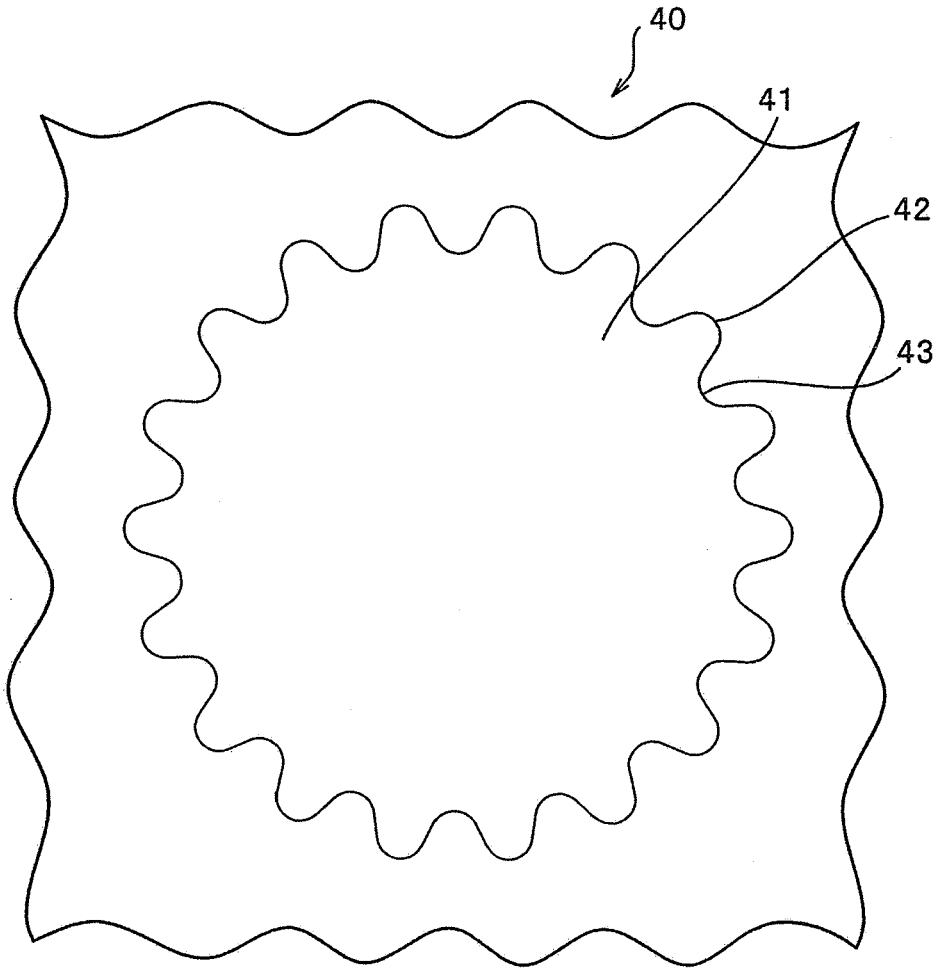
FIG. 7 is a diagram schematically illustrating the shape of a discharge port of an extrusion molding nozzle through which a monofilament is molded by extrusion.

In addition, in order to obtain the fastener element 20 besides the fastener tape 11, the monofilament 30 including thermoplastic resin such as polyamide or polyester is formed first through an extrusion molding process using an extrusion molding nozzle 40 as illustrated in FIG. 7. At this time, a discharge port 41 of the extrusion molding nozzle 40 is a gear shape in which eighteen protrusions 42 are formed on the peripheral edge of the discharge port 41. In addition, the protrusions 42 of the discharge port 41 and recesses 43 formed between the protrusions 42 are formed in a symmetrical manner. The curvature of a convexly curved surface of the protrusion 42 is set to have substantially the same size as that of a concavely curved surface of the recess 43.

For this reason, the monofilament 30 is molded by extruding a thermoplastic resin through the extrusion molding nozzle 40. On the entire peripheral surface of the monofilament, the plurality of projected rims 31 are formed continuously and disposed in parallel to each other along the length direction, and the plurality of concave grooves 32 are disposed between the projected rims 31. Further, a maximum diameter of the monofilament 30 which is obtained through the extrusion molding process is about 2.2 mm.

Subsequently, the monofilament 30 formed by the extrusion molding process as described above is subjected to a stretching process. In the stretching process, the diameter of the monofilament 30 may be thin down, and the strength of the monofilament 30 may be increased by oriented crystallization of polymer. In addition, since pressure increases as it goes to the center line of the monofilament 30, the monofilament 30 immediately after the above-mentioned extrusion molding and the monofilament 30 during the stretching process become easy to expand to the outside. As a result, the monofilament 30 after the stretching process can be formed such that the curvature of the concavely curved surface of the concave groove 32 decreases (the curvature radius increases). Therefore, the concavely curved surface may be gently formed rather than the convexly curved surface of the projected rim 31. Further, the height of the projected rim 31 may be reduced based on the shape of the discharge port 41 of the extrusion molding nozzle 40.

Specifically, the stretching process of the embodiment may be performed to make a maximum diameter of the monofilament 30 reduced down to 0.74 mm which corresponds to the ⅓ dimension (2.2 mm) before the stretching process. In addition, the height of the projected rim 31 may fall within a range of 5 μm or more and 100 μm or less, and the size of the projected rim 31 may be regulated such that an average height of the entire projected rims 31 is 10 μm. With this configuration, as described above, in the cross section of the monofilament 30, the diameter of the first virtual circle 33 which is formed by connecting the bottoms of the concave grooves 32 is regulated to be 80% or more with respect to that of the second virtual circle 34 which is formed by connecting the apexes of the respective projected rims 31. Therefore, it is possible to stably obtain strength with which the monofilament 30 is durably used as the slide fastener 1.

Thereafter, the extended monofilament 30 is used to form a continuous fastener element 20. At this time, the continuous fastener element 20, for example, is taken a shape by pressing the monofilament 30 at a predetermined interval to form the expanded coupling heads 22, and then by winding the monofilament 30 in a coil shape.

When the continuous fastener element 20 is formed as described above, the direction of the projected rims 31 of the upper and lower leg portions 23 and 24 can be crooked with respect to the extending direction of the upper and lower leg portions 23 and 24. Further, when the monofilament 30 is used to form the continuous fastener element 20, the monofilament 30 itself receives various amounts of stress. Therefore, among the projected rims 31 and the concave grooves 32 disposed on the peripheral surface of the monofilament 30, a part of the projected rims 31 may be dented to be plastically deformed. In the case where the projected rims 31 are formed to be dented as described above, the dye may be retained with more stability at the time of retaining the dye into the concave groove 32 depending on the deformation of the projected rim 31 as to be described below.

In addition, the coupling head 22 and the connecting portion 25 of the fastener element 20 are plastically deformed more than the upper and lower leg portions 23 and 24 of the fastener element 20 at the time of forming the fastener element. Therefore, the height of the projected rims 31 disposed on the coupling head 22 and the connecting portion 25 (the depth of the concave groove 32) is reduced to be smaller than the upper and lower leg portions 23 and 24. Accordingly, when the fastener stringer 10 is configured by these components, the slider 8 may be improved in slidability.

When the continuous fastener element 20 formed as described above is then sewn on the tape side edge portion 11*b* of the fastener tape 11, the fastener stringer 10 of the embodiment having the above-mentioned configuration can be stably manufactured. Further, in the embodiment, while the continuous fastener element 20 is being formed using the monofilament 30, the formed fastener element 20 may be continuously sewn on the tape side edge portion 11*b* of the fastener tape 11. Therefore, it is possible to manufacture the fastener stringer 10 with efficiency.

In the above-mentioned fastener stringer 10 according to the embodiment, the eighteen projected rims 31 continuously formed along the length direction of the monofilament 30 and the eighteen concave grooves 32 formed between the projected rims 31 are formed in a predetermined size and disposed in parallel to each other over the entire peripheral surface of the monofilament 30. Further, in the cross section of the monofilament 30, the cross-sectional area 35 of the space region of the concave groove 32 which is defined by connecting the apexes of the projected rims 31 is set to be larger than the cross-sectional area 36 of the projected rim 31 which is defined by connecting the bottoms of the concave grooves 32.

When the fastener stringer 10 of the embodiment or a fastener chain made of a set of two coupled fastener stringers 10, for example, is subjected to the dyeing process by the beam dyeing, the fastener stringer 10 or the fastener chain is wound around a beam in an overlapping manner. Even in a state where the surface of the fastener element 20 wound in each layer comes in close contact with the rear surface of the fastener tape 11 wound in the next layer, a small gap is formed between the surface of the fastener element 20 and the rear surface of the fastener element 20 wound around the next layer due to the concave grooves 32. Therefore, since the dye flows along the concave grooves 32, the dye can spread even to the surface closely contacted with the fastener element 20.

Specifically, in the embodiment, the concave grooves 32 are disposed to be crooked with respect to the extending direction of the upper and lower leg portions 23 and 24. Therefore, even when the entire upper side of the upper leg portion 23 comes in close contact with the rear surface of the fastener tape 11, the dye can spread easily even to the upper surface of the upper leg portion 23 along the concave grooves 32. Accordingly, the fastener stringer 10 or the fastener chain can be evenly dyed with a desired color without dyeing irregularities and dyeing defects in the fastener element 20.

In addition, when the fastener stringer 10 or the fastener chain of the embodiment are subjected to the dyeing process, for example, using the continuous dyeing method, the fastener stringer 10 or the fastener chain is immersed into a dyeing bath to attach the dye to the surfaces of the fastener tape 11 and the fastener element 20. At this time, since the peripheral surface of the monofilament 30 is provided with the concave grooves 32, the dye is received in the concave grooves 32. Accordingly, the dye can be stably retained in the surface of the fastener element 20.

Therefore, it is possible to prevent defects such as disproportion in amount of the dye attached on the surface of the fastener element 20, and partially falling of the dye until the fastener stringer 10 or the fastener chain immersed into the dyeing bath is subjected to thermal treatment. Further, the fastener stringer 10 or the fastener chain can be evenly dyed with a desired color without the dyeing irregularities and the dyeing defects in the fastener element 20.

Furthermore, when the fastener stringer 10 or the fastener chain of the embodiment are subjected to the coloration using the inkjet scheme, the entire fastener stringer 10 or the entire fastener chain is ejected with the dye-based ink in the tape width direction from an inkjet nozzle disposed at the predetermined position while the fastener stringer 10 or the fastener chain is transported at a predetermined speed in the tape length direction.

At this time, ink droplets blown to the fastener tape 11 are soaked in the fibers constituting the fastener tape 11 to be fixed on the fastener tape 11. In addition, the ink droplets blown to the fastener element 20 are received into the concave groove 32 disposed on the peripheral surface of the fastener element 20 and thus it is possible for the ink droplets to be stably fixed on the surface of the fastener element 20.

With this configuration, the adjacent ink droplets attached to the surface of the fastener element 20 can be prevented from being mixed to each other. Therefore, the pattern of the fastener element 20 is prevented from being blurred (the outlines of the patterns and the colors become cloudy), and thus it is possible to form the outlines of the patterns to be clear. Accordingly, thereafter, the fastener stringer 10 or the fastener chain with the ink droplets attached is subjected to the thermal treatment, a desired continuous pattern can be finely made on the fastener tape 11 and the fastener element 20, and the slide fastener 1 can be improved in visibility. Further, the surface of the resin and the inner portion near the surface can be dyed by the ink which is attached to the fastener tape 11 and the fastener element 20 through the thermal treatment.

Herein, the thermal treatment, for example, is also referred to as dry-heat treatment in which the fastener stringer 10 or the fastener chain is transported in a heated atmosphere. Further, the above-mentioned description has been made in connection with the case where a predetermined length of the fastener stringer 10 or the fastener chain is blown with the ink droplets and is subjected to the thermal treatment. However, according to the invention, since the slide fastener 1 is configured to include a pair of the fastener stringers 10 to which the top stops 6, the bottom stops 7, and the slider 8 are attached, the slide fastener 1 may be subjected to the coloration by the inkjet scheme.

In addition, the coloration by the above-mentioned inkjet scheme has been described in connection with the case where the fastener stringer 10 or the fastener chain is colored using the dye-based ink. However, the invention may employ a coloring method using the pigment-based ink instead of the dye-based ink. The pigment-based ink, unlike the dye-based ink whose dye is dissolved in a solvent, is a type of ink whose dye is dispersed without being dissolved in the solvent. Even in a case where the slide fastener 1 is colored using the pigment-based ink, the ink droplets can be stably fixed in the concave groove 32 of the fastener element 20, and thus the outline of the patterns may appear beautiful.

In this case, the pigment-based ink can be stably retained in the concave groove 32 disposed on the surface of the fastener element 20. Therefore, in a case such as when the slider 8 is sliding on the composed slide fastener 1, when the slide fastener 1 comes into conflict with another product, and similar cases, it is possible to effectively suppress that the pigment-based ink is peeled off from the fastener element 20 due to the friction and the impact on the fastener element 20.

Furthermore, the fastener stringer 10 or the fastener chain of the embodiment may be blown to coat the fastener element 20 with a color. In addition, the fastener stringer 10 or the fastener chain may be subjected to a deposition process in a vacuum state to perform surface treatment in which a metal thin film is formed on the surface of the fastener element 20. Furthermore, the surface of the fastener element 20 may be subjected to surface treatment in which a sheet-like film adheres through a thermal transfer process.

Then, when the fastener stringer 10 or the fastener chain of the embodiment is subjected to the surface treatment such as the coloration and the vacuum deposition process through a coating operation as described above, since the plurality of predetermined-sized concave grooves 32 are disposed on the fastener element 20, a part of a coating film or a thin film goes into and certainly fixed to each concave grooves 32. With this configuration, a bonding strength can significantly increase between the fastener element 20 and the coating film or the thin film formed on the surface (the peripheral surface) of the fastener element 20. Therefore, it is possible to prevent the coating film or the thin film formed on the fastener element 20 from being easily peeled off.

In addition, when the fastener stringer 10 or the fastener chain of the embodiment is subjected to the surface treatment in which the sheet-like film adheres through the thermal transfer process, the plurality of predetermined-sized concave grooves 32 are disposed on the fastener element 20. Therefore, the concave grooves 32 easily receive an adhesive, and thus it is possible to certainly perform the bonding of the film. With this configuration, the bonding strength can significantly increase between the fastener element 20 and the film bonded to the fastener element 20. Therefore, it is possible to prevent the bonded film from being easily peeled off.

Further, as described above regarding the dyeing and the coating, the dyeing is to dye the surface of the resin and the inner portion near the surface, and the coating is to stack a color onto the surface. For this reason, when the fastener tape and the fastener element are dyed, it is preferable that the fastener tape and the fastener element employ materials which are colored with the same dye. For example, in a case where the material of the fastener tape is a polyester resin, the fastener element preferably employs a polyester-based resin or polybutylene terephthalate. Alternatively, in a case where the material of the fastener tape is a polyamide resin, the fastener element preferably employs a polyamide-based resin. In this case, coloring the fastener element with a desired color is referred to as a coloration, and the dyeing process is included in the coloration.

In addition, according to the fastener stringer 10 of the embodiment, on the peripheral surface of the fastener element 20, the projected rims 31 and the concave grooves 32 of a predetermined size are formed continuously and disposed in parallel to each other along the length direction of the monofilament 30. With this configuration, it is possible to prevent the strength of the monofilament 30 from being locally lowered in the length direction of the monofilament 30, and to stably secure the strength suitable for the use of the slide fastener 1.

Furthermore, since the outer peripheral surfaces of the projected rim 31 and the concave groove 32 are substantially the curved surface shape, it is possible to prevent the slider 8 from rattling in a state of being stuck in the projected rim 31 and the concave groove 32 when the slider 8 is sliding on the composed slide fastener 1. Therefore, the slider 8 can smoothly slide. Furthermore, since the projected rim 31 and the concave groove 32 are continuously disposed along the length direction of the monofilament 30, it is possible to prevent resistance between the slider 8 and the fastener element 20 in sliding operation of the slider 8 from being changed. Therefore, a good operability of the slide fastener 1 can be stably secured.

When the slide fastener 1 which includes a pair of the left and right fastener stringers 10 provided with the above-mentioned configuration, for example, is subjected to the dyeing process by the beam dyeing or the dyeing process by the continuous dyeing method, it is possible to prevent the dyeing irregularities and the dyeing defects from being arisen in the fastener element, and the slide fastener is improved in visibility. In addition, when the coloration is performed using the inkjet scheme, a desired continuous pattern can be finely formed on the fastener tape 11 and the fastener element 20, and the slide fastener is improved in visibility.

Furthermore, when the coating treatment through the blowing process, the surface treatment in which the metal thin film is formed by the vacuum deposition, or the surface treatment in which the sheet-like film is bonded through the thermal transfer process is performed, the coating film, the thin film, or the film is difficult to be peeled off. Therefore, the quality of the slide fastener 1 can be stably maintained for a long time.

In particular, according to the slide fastener 1 of the embodiment as described above, the direction crooked with respect to the tape width direction of the projected rims 31 and the concave grooves 32 of the right fastener element 20 is the opposite direction to the direction crooked with respect to the tape width direction of the projected rims 31 and the concave grooves 32 of the left fastener element 20, with the left and right fastener stringers 10 as the center. With this configuration, the left and right fastener stringers 10 can be symmetrically colored using the concave grooves 32. Therefore, it is possible to suppress uncomfortable feeling in visibility between the pair of left and right fastener stringers 10.

Further, the above-mentioned embodiment has been mainly described in connection with the standard type of slide fastener 1 and the fastener stringer 10 used in the slide fastener 1, but the invention is not limited to the type of slide fastener 1. For example, the invention may be preferably applied to a hidden type of slide fastener.

Figure 8:
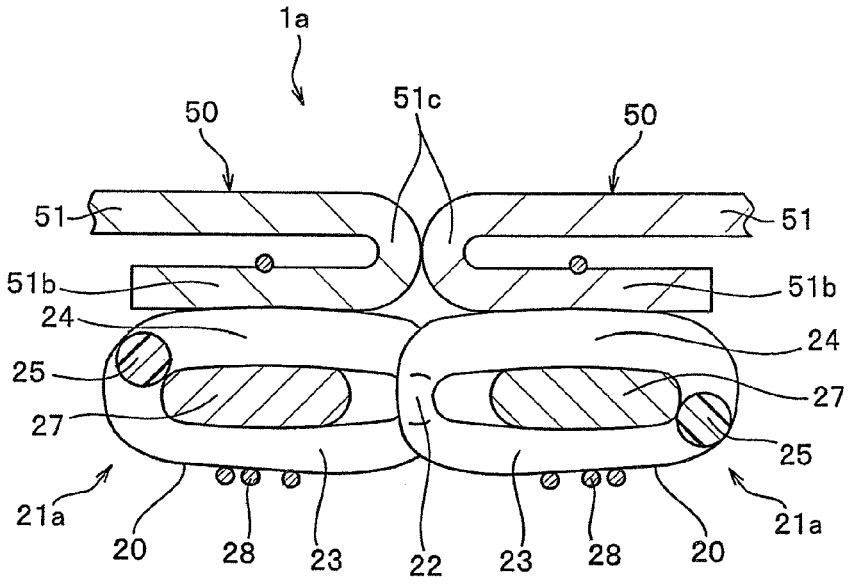
FIG. 8 is a cross-sectional view illustrating a slid fastener according to another embodiment of the invention.

Herein, the hidden type of slide fastener 1*a* different from the above-mentioned embodiment will be simply described with reference to FIG. 8. The hidden type of slide fastener 1*a* includes a pair of left and right fastener stringers 50, and also includes the top stops, the bottom stops, and the slider (not illustrated) which are generally used in the related art.

The fastener stringer 50 includes a fastener tape 51 which is bent in an approximate U shape and an element row 21*a* which is disposed along a tape side edge portion 51*b* of the fastener tape 51. The element row 21*a* is configured such that the fastener element 20 continuously formed in the coil shape is sewn on the fastener tape 51 using the sewing yarn 28. In this case, the fastener tape 51 is configured such that, when the left and right element rows 21*a* are coupled, tape bent portions 51*c* of the left and right fastener tapes 51 come in contact with each other.

In the hidden type of slide fastener 1*a*, the fastener element 20 is configured as described in the above embodiment, the coupling head 22, and includes the upper and lower leg portions 23 and 24 and the connecting portion 25. However, the direction in which the fastener element 20 is sewn on the fastener tape 51 is different from that of Embodiment 1 described above.

In other words, when the fastener element 20 is sewn, before the fastener tape 51 is bent as described above, the core thread 27 is inserted between the upper and lower leg portions 23 and 24 of the fastener element 20. Then, the upper and lower leg portions 23 and 24 are sewn on the tape side edge portion 51*b* of the fastener tape 51 in a state where the coupling head 22 is disposed to face the inner side of the fastener tape 51. Thereafter, the fastener tape 51 is bent in the U shape, and the bent fastener tape 51 is subjected to thermal setting. Therefore, the fastener stringer 50 is obtained in a state where the coupling head 22 of the fastener element 20 is disposed to protrude to the outside from the tape bent portion 51*c* of the fastener tape 51.

When two obtained fastener stringers 50 are combined in pairs, the hidden type of slide fastener 1*a* can be completely configured in which the coupling heads 22 of the left and right fastener elements 20 are appropriately coupled to each other. Further, the hidden type of slide fastener 1*a* may be sewn on fastener attached products such as clothes and bags, in which the fastener element 20, for example, is disposed on the outer surface (a portion exposed to the outside) of the slide fastener 1*a*.

Even in the hidden type of slide fastener 1*a*, the projected rims 31 and the concave grooves 32 which are the same as those in the standard type of slide fastener 1 according to the above-mentioned embodiment are disposed on the entire peripheral surface of the fastener element 20. The same effects as those described in connection with the standard type of slide fastener 1 can be obtained.

In addition, in the standard type of slide fastener 1 according to the above-mentioned embodiment, and in the hidden type of slide fastener 1*a* according to a modified example, the descriptions have been made in connection to the case where the diameter (the maximum diameter) of the monofilament 30 forming the fastener element 20 is 0.74 mm, the peripheral surface of the monofilament 30 is provided with the eighteen projected rims 31. However, the invention is not specifically limited in the diameter (the maximum diameter) of the monofilament 30 and the number of projected rims 31 and concave grooves 32 disposed on the peripheral surface of the monofilament 30, which can be arbitrarily changed.

Further, it is assumed a case where the number of projected rims 31 and concave grooves 32 disposed on the peripheral surface of the monofilament 30 is set though it depends on the diameter (the maximum diameter) of the monofilament 30. For example, a case where the diameter of the monofilament 30 falls within a range of 0.35 mm or more and 2.30 mm or less, the number of projected rims 31 and concave grooves 32 disposed on the peripheral surface of the monofilament 30 is preferably set in a range of 12 or more and 72 or less, and more preferably 12 or more and 48 or less in order to stably obtain the effects of the projected rims 31 and the concave grooves 32 in the coloration or the surface treatment of the fastener element.

Figure 9:
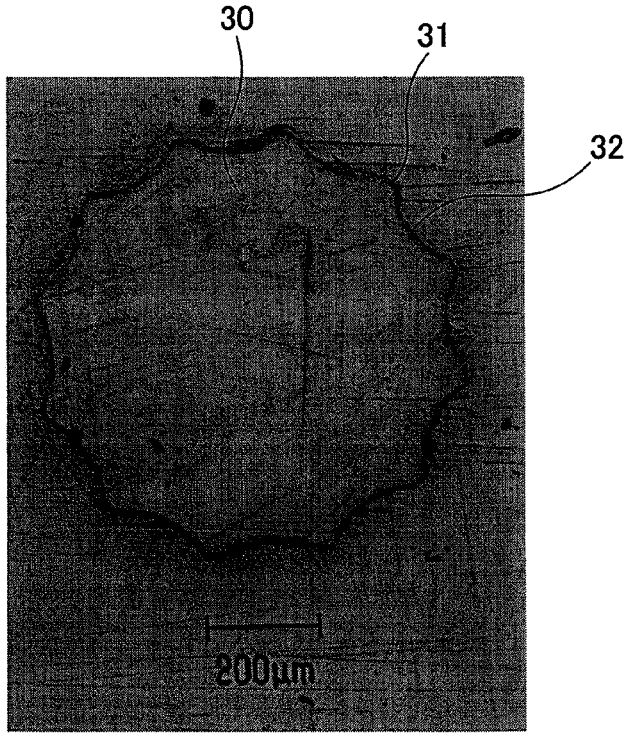
FIG. 9 is a cross-sectional view illustrating the upper leg portion of the fastener element, in which twelve projected rims are disposed on the peripheral surface of the monofilament.
Figure 10:
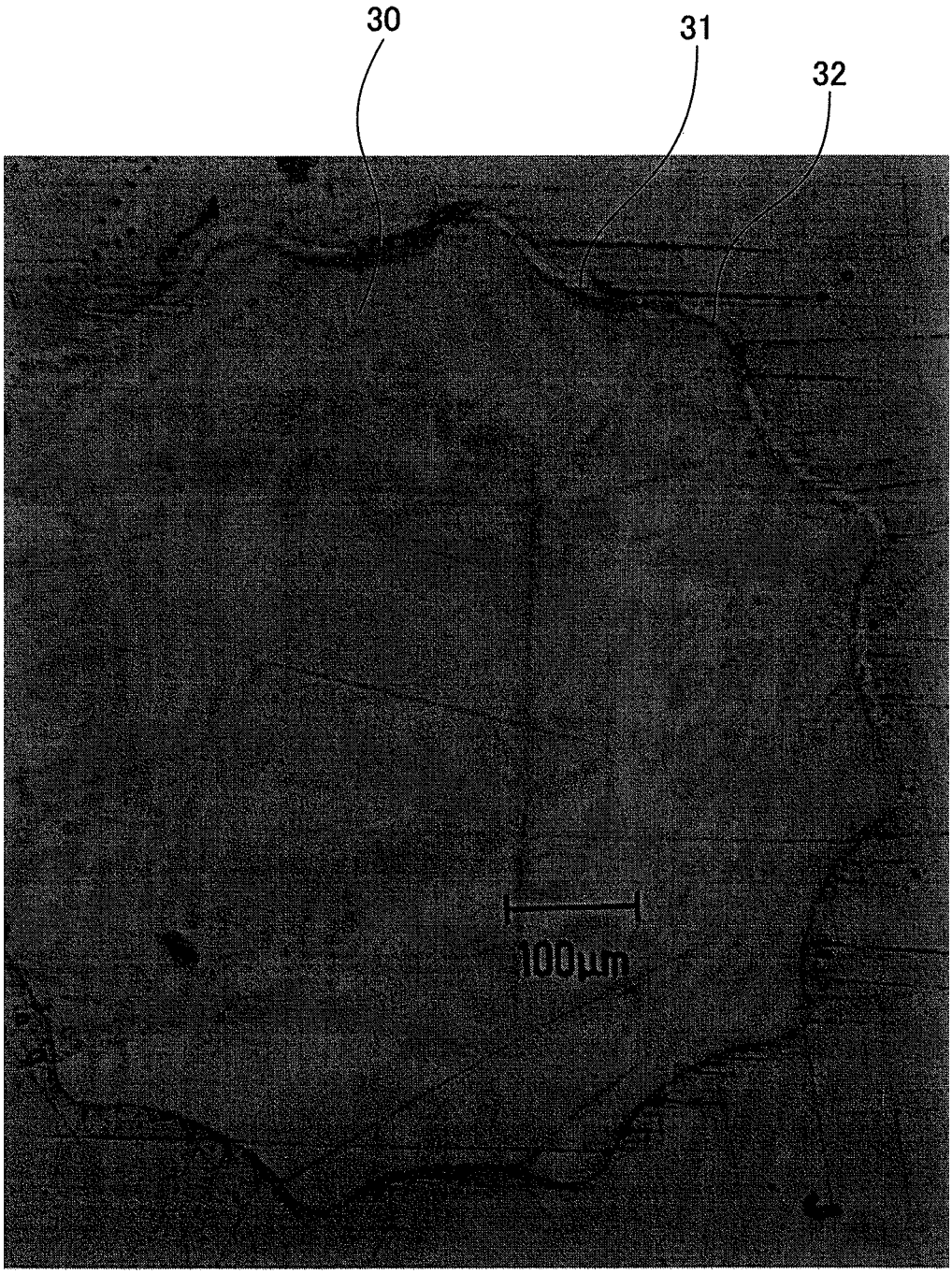
FIG. 10 is an enlarged cross-sectional view illustrating the cross section of the upper leg portion of the fastener element.
Figure 11:
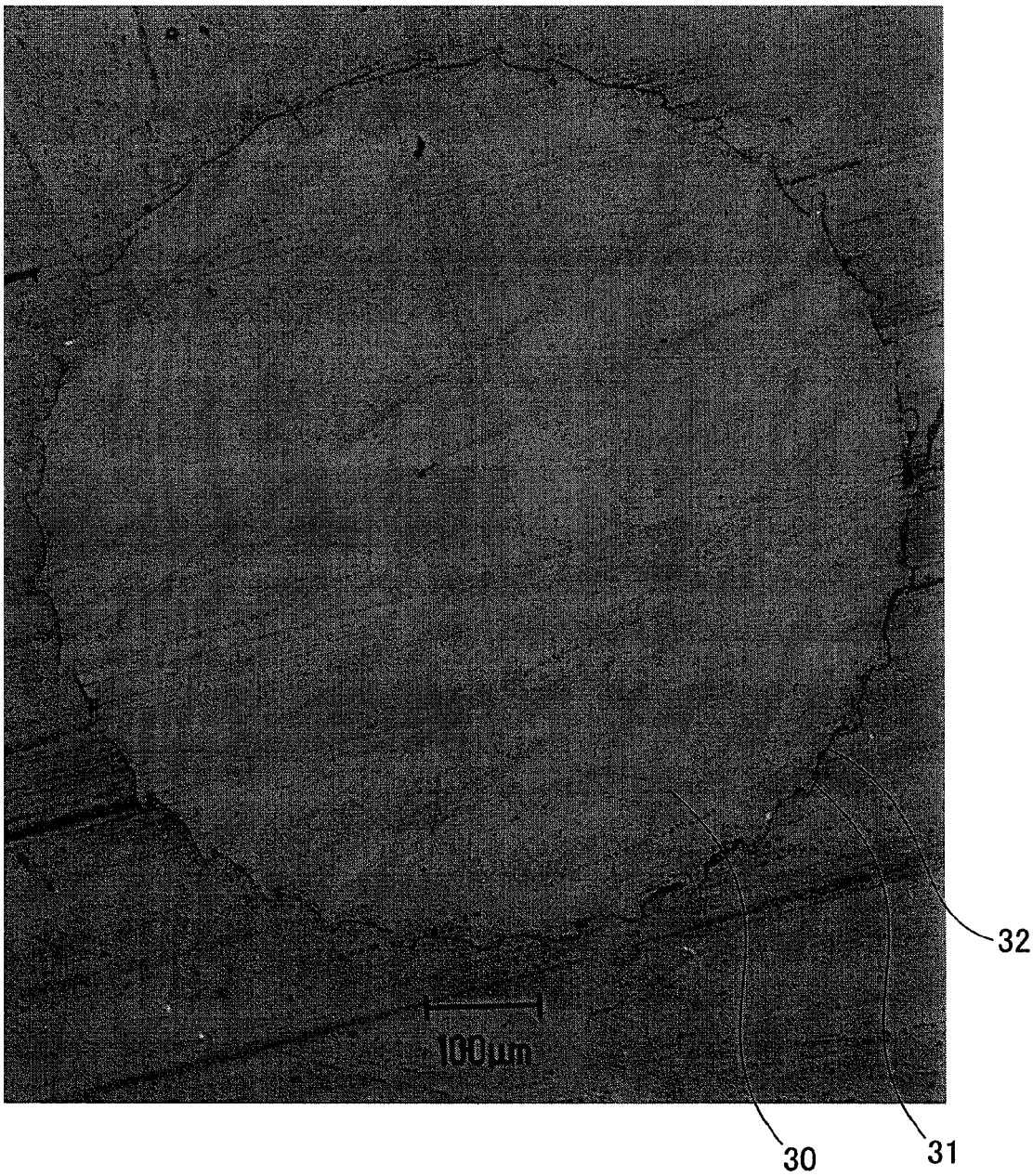
FIG. 11 is a cross-sectional view illustrating the upper leg portion of the fastener element, in which thirty-six projected rims are disposed on the peripheral surface of the monofilament.
Figure 12:
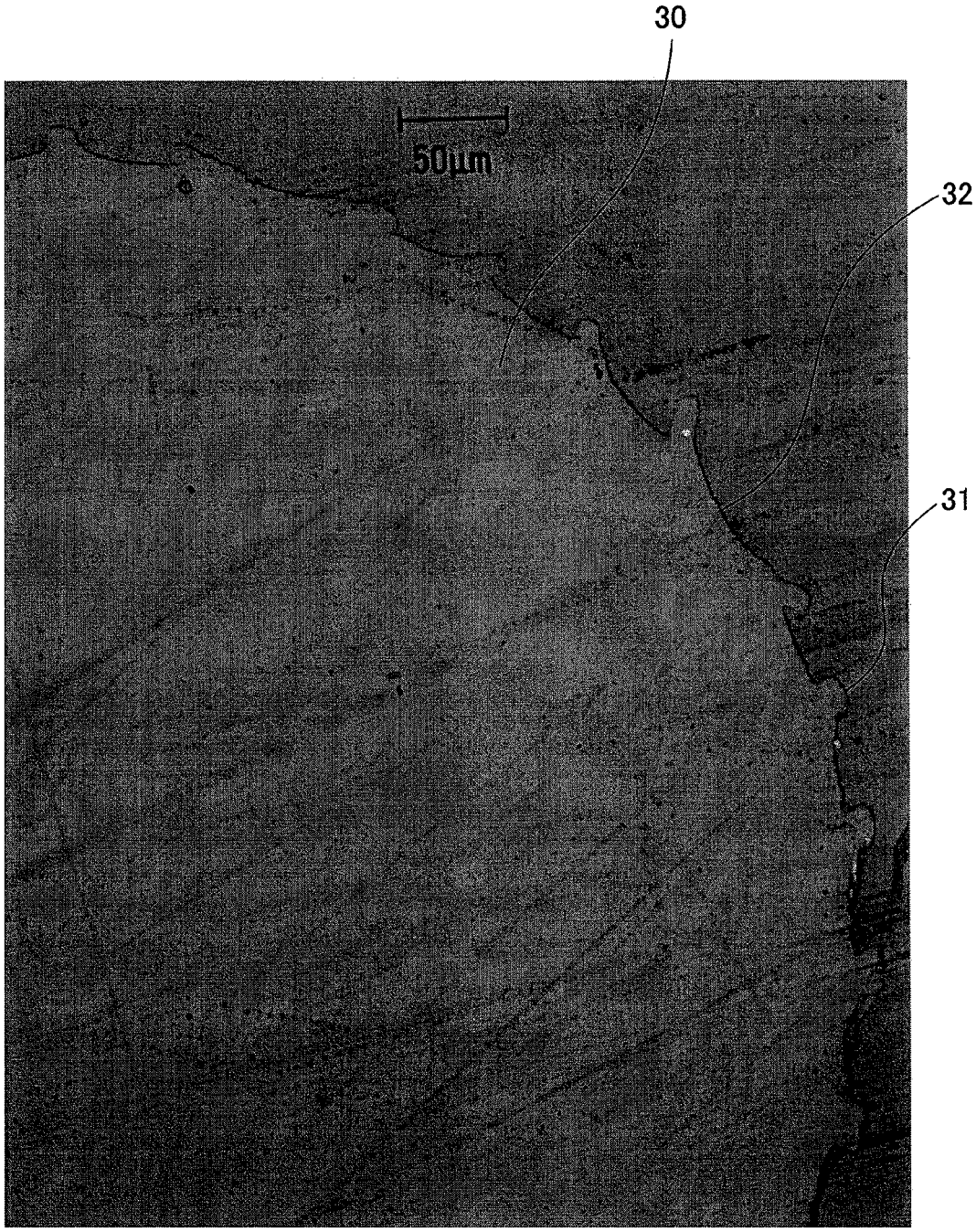
FIG. 12 is an enlarged cross-sectional view illustrating the cross section of the upper leg portion of the fastener element.

For example, in a case where the diameter (the maximum diameter) of the monofilament 30 is set to 0.74 mm as described in the above-mentioned embodiment, the number of projected rims 31 and concave grooves 32 disposed on the peripheral surface of the monofilament 30 may be set to 12 as illustrated in FIGS. 9 and 10. Alternatively, the number may be set to 36 as illustrated in FIGS. 11 and 12.

Even in the case where the projected rims 31 and the concave grooves 32 are provided on the peripheral surface of the monofilament 30, similarly to the embodiment, the dyeing process by the beam dyeing or the dyeing process by the continuous dyeing method can be stably performed without the dyeing irregularities and the dyeing defects, while the strength of the monofilament 30 is secured appropriately. In addition, in the case where the coloration by the inkjet scheme is performed, a desired pattern can be continuously formed on the fastener tape 11 and the fastener element 20, and the outlines can be finely formed.

DESCRIPTION OF REFERENCE NUMERALS

1, 1*a*: Slide fastener
6: Top stop
7: Bottom stop
8: Slider
10: Fastener stringer
11: Fastener tape
11*a*: Tape body portion
11*b*: Tape side edge portion
20: Fastener element
21, 21*a*: Element row
22: Coupling head
23: Upper leg portion
24: Lower leg portion
25: Connecting portion
27: Core thread
28: Sewing yarn
30: Monofilament
31: Projected rim
32: Concave groove
33: First virtual circle
34: Second virtual circle
35: Cross-sectional area of space region
36: Cross-sectional area of projected rim
40: Extrusion molding nozzle
41: Discharge port
42: Protrusion
43: Recess
50: Fastener stringer
51: Fastener tape
51*b*: Tape side edge portion
51*c*: Tape bent portion

What is claimed is:

1. A fastener stringer for a slide fastener in which a continuous fastener element formed of a monofilament is attached to a tape side edge portion of a fastener tape and at least a part of the fastener element is subjected to coloration or surface treatment, wherein:

the fastener element includes a plurality of fine projected rims which are continuously disposed on a peripheral surface of the monofilament along a length direction of the monofilament and a plurality of fine concave grooves which are disposed between the projected rims; and in a cross section of the monofilament, a cross-sectional area of a space region of the concave groove which is defined by connecting apexes of the adjacent projected rims is set to be larger than a cross-sectional area of the projected rim which is defined by connecting bottoms of the adjacent concave grooves.

2. The fastener stringer according to claim 1, wherein the height of the projected rim is set to 2.5 μm or more and 200 μm or less.

3. The fastener stringer according to claim 1, wherein in the cross section of the monofilament, the diameter of a first virtual circle which is formed by connecting the bottoms of the concave grooves is set to be 80% or more with respect to the diameter of a second virtual circle which is formed by connecting the apexes of the projected rims.

4. The fastener stringer according to claim 1, wherein in the cross section of the monofilament, the interval between predetermined positions on the projected rims in a circumferential direction is set to 24 μm or more and 200 μm or less.

5. The fastener stringer according to claim 1, wherein the number of projected rims which are disposed on the peripheral surface of the monofilament is 12 or more and 72 or less.

6. The fastener stringer according to claim 1, wherein:

the fastener element includes a coupling head, upper and lower leg portions which extend from the coupling head in a tape width direction, and a connecting portion which connects one of the upper and lower leg portions to one of the upper and lower leg portions of the adjacent fastener element in a length direction of the fastener tape; and the projected rims disposed on at least the upper and lower leg portions are crooked with respect to a direction extending from the upper and lower leg portions.

7. The fastener stringer according to claim 1, wherein in the cross section of the monofilament, a curvature of a concavely curved surface of the concave groove is set to be smaller than that of a convexly curved surface of the projected rim.

8. The fastener stringer according to claim 1, wherein in the cross section of the monofilament, at least one of the projected rims is configured such that one curved surface portion which is disposed from an apex to the concave groove on one side is asymmetric to the other curved surface portion which is disposed from the apex to the concave groove on the other side.

9. A slide fastener wherein a pair of the fastener stringers according to claim 1 are provided on the left and right sides.

10. The slide fastener according to claim 9, wherein:

the projected rims disposed on the upper and lower leg portions of the fastener element are crooked with respect to a direction extending from the coupling head of the upper and lower leg portions; and the crooked directions of the projected rims with respect to the extending direction of the upper and lower leg portions are opposite to each other in the left and right fastener stringers.

* * * * *

UNITED STATES PATENT AND TRADEMARK OFFICE

CERTIFICATE OF CORRECTION

PATENT NO. : 8,950,044 B2
APPLICATION NO. : 13/884358
DATED : February 10, 2015
INVENTOR(S) : Yoshimichi Yamakita It is certified that error appears in the above-identified patent and that said Letters Patent is hereby corrected as shown below:

On the Title page

Item (57), in column 2, in "Abstract", line 1, delete "stringer," and insert -- stringer --, therefor.

Item (57), in column 2, in "Abstract", line 4, delete "monofilament (30);" and insert -- monofilament; --, therefor.

Item (57), in column 2, in "Abstract", line 14, delete "inkjet," and insert -- inkjet --, therefor.

Signed and Sealed this
Fourth Day of August, 2015

Michelle K. Lee

Michelle K. Lee
*Director of the United States Patent and Trademark Office*